United States Patent [19]

Matsuura et al.

[11] 3,960,198

[45] June 1, 1976

[54] REDUCED PRESSURE MOULD PRODUCTION METHOD

[75] Inventors: Hiroshi Matsuura; Kazuo Ishimoto; Takashi Yasukuni, all of Mihara, Japan

[73] Assignee: Mitsubishi Jukogyo Kabushiki Kaisha, Tokyo, Japan

[22] Filed: Apr. 25, 1975

[21] Appl. No.: 571,558

[52] U.S. Cl. ..... 164/7; 164/40; 164/171

[51] Int. Cl.[2] ..... B22D 7/04; B22D 9/02

[58] Field of Search ..... 164/7, 30, 31, 32, 33, 164/37, 38, 40, 160, 170, 171

[56] References Cited

UNITED STATES PATENTS

| | | | |
|---|---|---|---|
| 1,804,400 | 5/1931 | Davis | 164/31 |
| 2,757,426 | 8/1956 | Brennan | 164/7 UX |
| 2,835,004 | 5/1958 | Whitesell | 164/170 |
| 3,293,703 | 12/1966 | Iaccone | 164/160 |
| 3,830,279 | 8/1974 | Arbenz et al. | 164/7 |
| 3,887,321 | 6/1975 | Hijikota et al. | 164/160 X |

*Primary Examiner*—Ronald J. Shore
*Attorney, Agent, or Firm*—Cushman, Darby & Cushman

[57] ABSTRACT

An improved method of producing a mould under a reduced pressure is described herein. In the improved method, after a main pattern (1) having a protrusion and a recess is inserted with an auxiliary pattern (8) having the same shape as said recess and having an air-tight film (9) tightly adhered on its outer peripheral surface into said recess, said main pattern (1) is fixedly placed on a surface plate (2) provided with evacuating means, and the surface of the main pattern (1) including the upper surface of said surface plate but excluding the upper surface of said auxiliary pattern (8) is covered with an air-tight film (3). Then, after said air-tight film (3) has been tightly adhered onto the surface of the main pattern (1) excluding the upper surface of said auxiliary pattern (8) and onto the upper surface of the surface plate (2) with the evacuating means of the surface plate (2), said auxiliay pattern (8) is extracted from the main pattern (1). Subsequently, after a casting frame (4) provided with pressure reducction means has been placed on the surface plate (2), solid particles (7) are filled in said casting frame (4). Still further, after the entire top surface of said casting frame (4) and the solid particles (7) has been covered with an air-tight film (10), said air-tight films (3) and (9) are adhered onto the side of the solid particles (7) by reducing the pressure within said casting frame (4) with said pressure reduction means and by recovering an atmospheric pressure within the surface plate (2), and then the main pattern (1) as well as the surface plate (2) are separated from the casting frame (4).

1 Claim, 4 Drawing Figures

REDUCED PRESSURE MOULD PRODUCTION METHOD

The present invention relates to improvements in the so-called reduced pressure mould production method, in which upon production of a casting mould, heat-resistive solid particles (casting sand) free from a binder is solidified by reducing the pressure therewithin, and thereby a mould can be produced.

The reduced pressure mould production method is a method of producing a casting mould comprising the steps of covering a surface of a pattern fixedly placed on a surface plate provided with evacuating means with an air-tight sheet, adhering said air-tight sheet onto the surface of the pattern with the evacuating means of said surface plate, placing a casting frame provided with pressure reduction means on the surface plate, filling the casting frame with heat-resistive solid particles (casting sand) free from a binder, covering the entire surface of the casting frame and the solid particles with an air-tigt sheet to shield them from the atmosphere, adhering the air-tight sheet on the surface of the pattern onto the side of the solid particles filled within the casting frame by reducing the pressure within the casting frame with the pressure reduction means of the casting frame and at the same time by communicating the side of the surface plate to the atmosphere, and separating the pattern as well as the surface plate from the casting frame, whereby a casting mould having an air-tight sheet on its surface may be produced within the casting frame.

Although the aforementioned reduced pressure mould production method had various advantages in contrast to the general mould production methods in the prior art, on the other hand it had a difficulty in that the applicable range of the moulds to be produced was limited by elongation or a rate of plastic deformation of the air-tight film to be tightly adhered onto the surface of the pattern, and also it involved a problem that the method is hardly applicable to production of a mould of complexed shape having many protrusions and recesses.

Figure 1:
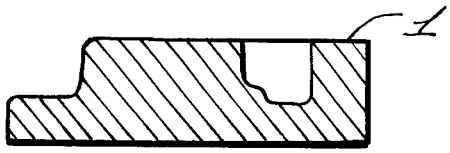
Figure 2:
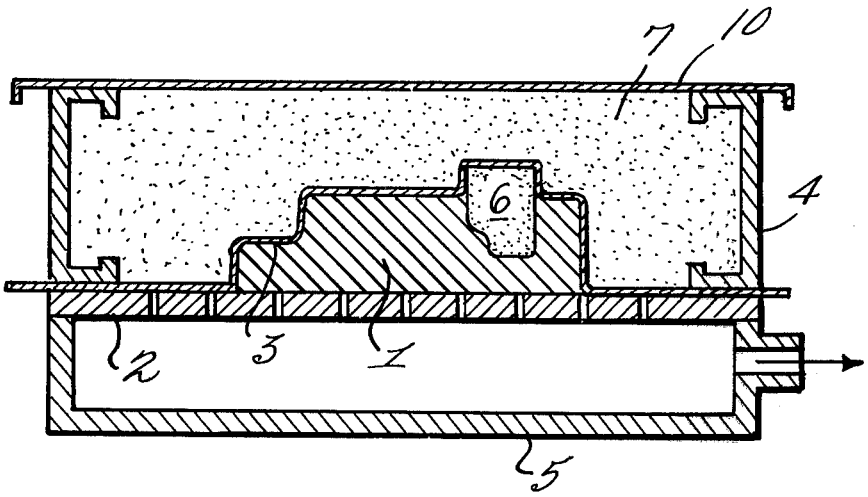

Accordingly, heretofore, in case of reduced prossure production of a mould for a pattern 1 as shown in FIG. 1 which has protrusions and recesses on its surface and which can be hardly adhered with an air-tight film tightly on its surface, it was a common practice that after a separately produced sand mould (hereinafter referred to as "core") 6 was set in said mould as shown in FIG. 2, the assembly was fixedly placed on a surface plate 2 provided with evacuating means (suction box 5), the surface of the pattern 1 and the sand mould 6 including the surface plate 2 was covered with an air-tight film 3, then said air-tight film 3 was tightly adhered onto the surface of the pattern 1 and the sand mould 6 including the upper surface of the surfae plate 2 by evacuating the suction box 5, thereafter a moulding frame 4 provided with pressure reduction means was placed on the surface plate 2, solid particles 7 was filled within said casting frame 4, further the entire surface of the casting frame 4 and the solid particles 7 was covered with an air-tight film 10, and subsequently by reducing the pressure within the casting frame 4 and by simultaneously recovering an atmospheric pressure in the suction box 5, the mould was produced.

However, according to the above-described method, in case of producing a large number of identical moulds, the same number of cores 6 must be produced, and so there was a disadvantage that the method required a lot of labour and expense.

Therefore, it is a principal object of the present invention to provide a reduced pressure mould production method, which is applicable even to a complexed shape of mould having many protrusions and recesses without requiring a lot of labour and expense.

According to one feature of the present invention there is provided a reduced pressure mould production method, characterized by the steps of inserting into a recess of a main pattern 1 having a protrusion and a recess and auxiliary pattern 8 having the same shape as said recess and having an air-tight film 9 tightly adhered on its outer peripheral surface, thereafter placing said main pattern 1 fixedly on a surface plate 2 provided with evacuating means, covering the surface of the main pattern 1 including the upper surface of said surface plate but excluding the upper surface of said auxiliary pattern 8 with an air-tight film 3, then tightly adhering said air-tight film 3 onto the surface of the main pattern 1 excluding the upper surface of said auxiliary pattern 8 and onto the upper surface of the surface plate 2 with the evacuating means of the surface plate 2, thereafter extracting said auxiliary pattern 8 from the main pattern 1, subsequently placing a casting frame 4 provided with pressure reduction means on the surface plate 2, thereafter filling said casting frame 4 with solid particles 7, further covering the entire top surface of said casting frame 4 and the solid particles 7 with an air-tight film 10, thereafter adhering said air-tight films 3 and 9 onto the side of the solid particles 7 by reducing the pressure within said casting frame 4 with said pressure reduction means and by recovering an atmospheric pressure within the surface plate 2, and then separating the main pattern 1 as well as the surface plate 2 from the casting frame 4.

Figure 3:
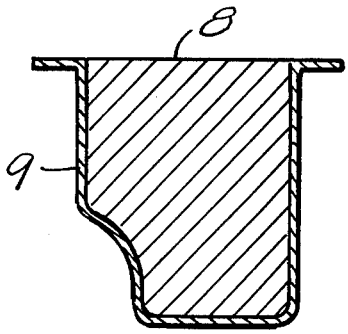
Figure 4:
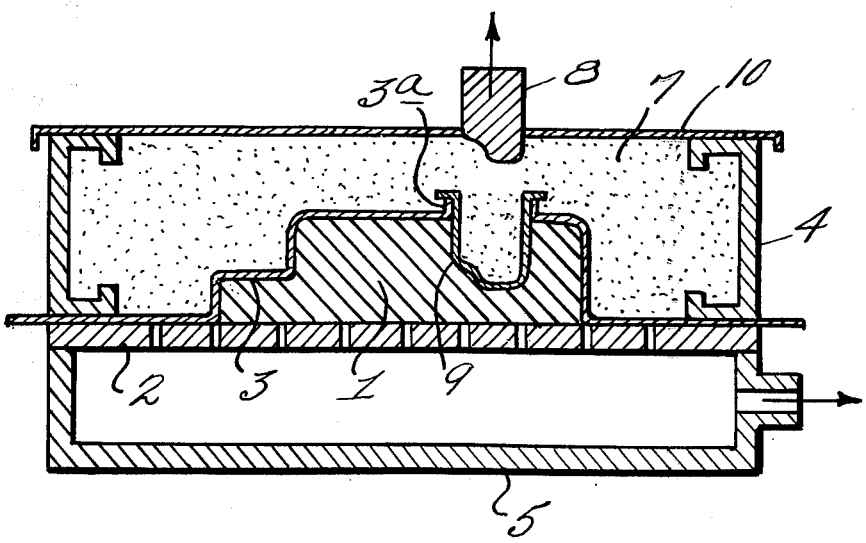

Above-mentioned and other features and objects of this invention will become more apparent by reference to the following description taken in conjunction with the accompanying drawings, in which:

FIG. 1 is a longitudinal cross-section view of a pattern having a lot of protrusions and recesses, FIG. 2 is a schematic view showing the conventional reduced pressure mould production method employing a core, FIG. 3 is a longitudinal cross-section view of an auxiliary model employed according to the present invention, and FIG. 4 is a schematic view showing one preferred embodiment of the present invention.

Now the method according to the present invention will be described in more detail with reference to FIGS. 3 and 4 of the accompanying drawings. It is to be noted that in the following description the present invention is explained as applied to the case where the reduced pressure mould production is carried out employing a model 1 having protrusions and recesses as shown in FIG. 1.

In FIG. 3, reference numeral 8 designates an auxiliary pattern formed in the same shape as a recess of a main pattern, and on the surface of the auxiliary pattern 8 is tightly adhered an air-tight film 9. After the auxiliary pattern 8 having an air-tight film 9 tightly adhered onto its surface has been fitted in the recess of the main pattern as shown in FIG. 4, the assembly consisting of the main pattern 1 and the auxiliary pattern 8 is fixedly placed on a surface plate 2 provided with evacuating means, and then the surface of the main pattern 1 including the upper surface of the surface plate 2 and the upper surface of the auxiliary pattern 8 are covered with an air-tight film 3 according to the same processes as the conventional reduced pressure mould production methods.

Subsequently, after the portion of the air-tight film 3 tightly adhered onto the upper surface of the auxiliary pattern 8 has been cut away by means of a cutting tool such as a knife and the like, the auxiliary pattern 8 is extracted from the main pattern 1. Then, after a casting frame 4 has been placed on the surface plate 2, said casting frame 4 is filled with solid particles 7. Thereafter, according to similar processes to the conventional methods, the air-tight films 3 and 9 are adhered onto the side of the solid particles 7 by reducing the pressure within the casting frame 4 and by recovering an atmospheric pressure in the suction box 5 of the surface plate 2. In this case, since the portion of the air-tight film 3 at the circumference of the cut-away portion and the air-tight film 9 are completely tightly adhered to each other by the suction effect caused by pressure reduction, there is no need to bond their joint portion by taping. Here, the main pattern 1 as well as the surface plate 2 are separated from the casting frame 3. Then, there is provided a mould having air-tight films 3 and 9 adhered onto its surface.

As the present invention is characterized by the aforementioned steps, the following practical advantages can be realized by the present invention:

1. The limit of the applicable range of the reduced pressure mould production method caused by insufficient elongation and an insufficient rate of plastic deformation of the air-tight film tightly adhered onto the surface of the pattern can be eliminated, and even a mould having a lot of protrusions and recesses can be easily produced.

2. In case of producing a large number of identical moulds, a single auxiliary pattern can be repeatedly used any time in contrast to the prior art method employing a core, so that the labour can be reduced, the expense can be reduced, and also mounting of the auxiliary mould to the main mould can be achieved easily.

While we have described above the principle of our invention in connection with a specific embodiment, it is to be clearly understood that this description is made only by way of example and not as a limitation to the scope of the invention as set forth in the objects thereof and in the accompanying claim.

What is claimed is:

1. A reduced pressure mould production method, characterized by the steps of inserting into a recess of a main pattern (1) having a protrusion and a recess an auxiliary pattern (8) having the same shape as said recess and having an air-tight film (9) tightly adhered on its outer peripheral surface, thereafter placing said main pattern (1) fixedly on a surface plate (2) provided with evacuating means, covering the surface of the main pattern (1) including the upper surface of said surface plate but excluding the upper surface of said auxiliary pattern (8) with an air-tight film (3), then tightly adhering said air-tight film (3) onto the surface of the main pattern (1) excluding the upper surface of said auxiliary pattern (8) and onto the upper surface of the surface plate (2) with the evacuating means of the surface plate (2), thereafter extracting said auxiliary pattern (8) from the main pattern (1), subsequently placing a casting frame (4) provided with pressure reduction means on the surface plate (2), thereafter filling said casting frame (4) with solid particles (7), further covering the entire top surface of said casting frame (4) and the solid particles (7) with an air-tight film (10), thereafter adhering said air-tight films (3) and (9) onto the side of the solid particles (7) by reducing the pressure within said casting frame (4) with said pressure reduction means and by recovering an atmospheric pressure within the surface plate (2), and then separating the main pattern (1) as well as the surface plate (2) from the casting frame (4).

* * * * *